US009755405B2

(12) United States Patent
Mixell et al.

(10) Patent No.: US 9,755,405 B2
(45) Date of Patent: Sep. 5, 2017

(54) CORONA SUPPRESSION AT THE HIGH VOLTAGE JOINT THROUGH INTRODUCTION OF A SEMI-CONDUCTIVE SLEEVE BETWEEN THE CENTRAL ELECTRODE AND THE DISSIMILAR INSULATING MATERIALS

(71) Applicant: FEDERAL-MOGUL CORPORATION, Southfield, MI (US)

(72) Inventors: Kristapher Mixell, Plymouth, MI (US); Paul Phillips, Brighton, MI (US); Giulio Milan, Northville, MI (US); Massimo Dal Re, Concordia Sulla Secchia (IT)

(73) Assignee: Federal-Mogul LLC, Southfield, MI (US)

( * ) Notice: Subject to any disclaimer, the term of this patent is extended or adjusted under 35 U.S.C. 154(b) by 0 days.

(21) Appl. No.: 15/077,615

(22) Filed: Mar. 22, 2016

(65) Prior Publication Data

US 2017/0025824 A1 Jan. 26, 2017

Related U.S. Application Data

(60) Provisional application No. 62/138,642, filed on Mar. 26, 2015.

(51) Int. Cl.

| | |
|---|---|
| ***H01T 19/00*** | (2006.01) |
| ***H01T 13/20*** | (2006.01) |
| ***H01T 21/02*** | (2006.01) |
| ***H01T 13/44*** | (2006.01) |
| ***H01T 13/50*** | (2006.01) |
| *H01T 13/34* | (2006.01) |

(52) U.S. Cl.
CPC ..... *H01T 19/00* (2013.01); *H01T 13/20* (2013.01); *H01T 13/44* (2013.01); *H01T 13/50* (2013.01); *H01T 21/02* (2013.01); *H01T 13/34* (2013.01)

(58) Field of Classification Search
CPC ..... H01T 19/00; H01T 13/20; H01T 21/02
See application file for complete search history.

(56) References Cited

U.S. PATENT DOCUMENTS 2,139,793 A 12/1938 Benton
2,280,962 A 4/1942 McDougal
(Continued)

OTHER PUBLICATIONS

International Search Report, dated Jul. 4, 2016 (PCT/US2016/023855).

*Primary Examiner* — Joseph L Williams
(74) *Attorney, Agent, or Firm* — Robert L. Stearns; Dickinson Wright, PLLC

(57) ABSTRACT

A corona ignition assembly comprising a plurality of different insulators disposed between an ignition coil assembly and firing end assembly is provided. A high voltage center electrode extends longitudinally between an igniter central electrode and the ignition coil assembly. A high voltage insulator formed of a fluoropolymer surrounds the high voltage center electrode, and a firing end insulator firing of alumina surrounds the igniter central electrode. A sleeve formed of a semi-conductive and complaint material, such as silicone rubber with conductive filler, is disposed radially between the electrodes and adjacent insulators. The sleeve fills air gaps and minimizes the peak electric field within the corona igniter assembly. The sleeve is able to prevent unwanted corona discharge, and thus extends the life of the materials and directs energy to the firing end.

20 Claims, 16 Drawing Sheets

(56) References Cited

U.S. PATENT DOCUMENTS

| | | | |
|---|---|---|---|
| 2,959,703 | A | 11/1960 | Hastings, Jr. |
| 4,643,688 | A | 2/1987 | Byerly et al. |
| 6,329,743 | B1 | 12/2001 | Camilli |
| 8,365,710 | B2 | 2/2013 | Lykowski et al. |
| 8,550,048 | B2 | 10/2013 | Stifel et al. |
| 8,747,176 | B2 | 6/2014 | Lynch et al. |
| 8,767,372 | B2 | 7/2014 | Stifel et al. |
| 2013/0293089 | A1 | 11/2013 | Durham |
| 2014/0116369 | A1 | 5/2014 | Stifel et al. |
| 2014/0123925 | A1 | 5/2014 | Stifel |
| 2014/0137845 | A1 | 5/2014 | Achtstatter et al. |
| 2014/0216382 | A1 | 8/2014 | Stifel et al. |
| 2014/0261273 | A1 | 9/2014 | Achtstatter et al. |
| 2014/0268480 | A1 | 9/2014 | Urciuoli et al. |

Applied voltage: 30kV on each conductor

Teflon $\varepsilon_r = 2.08$
Semicon_rubber $\varepsilon_r = 10$
Semicond_rubberconductivity = 1,92E-3 S/m

Voltage gradient (V/m) for a geometry:
2.5mm CD equivalent brass terminals
1.0 mm thickness for semicond_rubber Applied voltage: 30kV Teflon $\varepsilon_r = 2.08$

Voltage gradient (V/m) for a geometry:
2.5mm CD brass terminals

(10) Tangential E-field. Comparison between semi conductive sleeve (0.7Ωm) and conductive sleeve of the same diameter RED: standard resistivity, 0.7Ωm. YELLOW-DASHED: no semi conductive, 4mm OD conductor.

CORONA SUPPRESSION AT THE HIGH VOLTAGE JOINT THROUGH INTRODUCTION OF A SEMI-CONDUCTIVE SLEEVE BETWEEN THE CENTRAL ELECTRODE AND THE DISSIMILAR INSULATING MATERIALS

CROSS-REFERENCE TO RELATED APPLICATION

This U.S. patent application claims the benefit of U.S. Provisional Patent Application No. 62/138,642, filed Mar. 26, 2015, which is incorporated herein by reference in its entirety.

BACKGROUND OF THE INVENTION

1. Field of the Invention

This invention relates generally to corona ignition assemblies, and methods of manufacturing the corona ignition assemblies.

2. Related Art

Corona igniter assemblies for use in corona discharge ignition systems typically include an ignition coil assembly attached to a firing end assembly as a single component. The firing end assembly includes a center electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create thermal plasma and an electric arc between the electrode and grounded cylinder walls, piston, or other portion of the igniter.

Ideally, the electric field is also controlled so that the corona discharge only forms at the firing end and not along other portions of the corona igniter assembly. However, such control is oftentimes difficult to achieve due to air gaps located between the components of the corona igniter assembly where unwanted corona discharge tends to form. For example, although the use of multiple insulators formed of different materials provides improved efficiency, robustness, and overall performance, the metallic shielding and the different electrical properties between the insulator materials leads to an uneven electrical field and air gaps at the interfaces. The dissimilar coefficients of thermal expansion and creep between the insulator materials can also lead to air gaps at the interfaces when operating in the −40° C. to 150° C. temperature range. During use of the corona igniter, the electrical field tends to concentrate in those air gaps. The high voltage and frequency applied to the corona igniter assembly ionizes the trapped air causes unwanted corona discharge. Such corona discharge can cause material degradation and hinder the performance of the corona igniter assembly.

In addition, the different materials disposed radially across the assembly can lead to an uneven distribution of electrical field strength between those materials. While moving from the coil to the firing end, the electrical field loads and unloads the capacitance in a direction moving radially between the electrode and external shield. The electrical field concentrated at the interfaces between the different electrode and insulator materials, and in any cavities or air voids between the materials, is typically high. Oftentimes, this voltage is higher than the voltage of corona inception, which could contribute to the unwanted corona discharge along the interfaces, cavities, or air voids.

SUMMARY OF THE INVENTION

One aspect of the invention provides a corona igniter assembly comprising an ignition coil assembly and a firing end assembly capable of maintaining the peak electric field below the voltage of corona inception. The firing end assembly includes an igniter central electrode surrounded by a ceramic insulator. A high voltage center electrode is coupled to the igniter central electrode. A high voltage insulator formed of a material different from the ceramic insulator surrounds the high voltage center electrode. A semi-conductive sleeve is disposed radially between the high voltage center electrode and the insulators and extends axially along an interface between the adjacent insulators. A dielectric compliant insulator is optionally disposed between the high voltage insulator and the ceramic insulator of firing end assembly. If the optional dielectric complaint insulator is present, then the semi-conductive sleeve is also disposed radially between the high voltage center electrode and the dielectric complaint insulator and extends axially along the interfaces between the dielectric compliant insulator and the adjacent insulators.

Another aspect of the invention provides a method of manufacturing the corona igniter assembly by disposing the semi-conductive sleeve radially between the high voltage center electrode and the different insulator.

The semi-conductive sleeve relieves stress and stabilizes the electrical field between the different materials disposed radially across the corona igniter assembly, where more air gaps or changes in geometry leading to increases in electric field typically exist. More specifically, the semi-conductive sleeve minimizes the peak electric field within the corona igniter assembly by contrasting the electric charge concentration in any air gaps located along the high voltage center electrode or ceramic insulator. The voltage drop through the semi-conductive sleeve is significant, and thus the voltage peak at the interface between the semi-conductive sleeve and the adjacent materials is lower than the voltage peak between the high voltage center electrode and the ceramic insulator would be without the semi-conductive sleeve. Studies show that the semi-conductive sleeve performs like an actual conductor, with limited loss of power, when fed with a high frequency and high voltage (HV-HF).

The semi-conductive sleeve also conducts charge away and relieves any cavities from static electrical charge that could generate unwanted corona discharge. Furthermore, the semi-conductive sleeve is typically formed of a compliant material, and thus minimizes the amount or volume of air gaps along the interfaces between the high voltage center electrode and the ceramic insulator. In summary, by preventing the unwanted corona discharge, the life of the materials can be extended and the energy can be directed to the corona discharge formed at the firing end, which in turn improves the performance of the corona igniter assembly.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF EXAMPLE EMBODIMENTS

Figure 1:
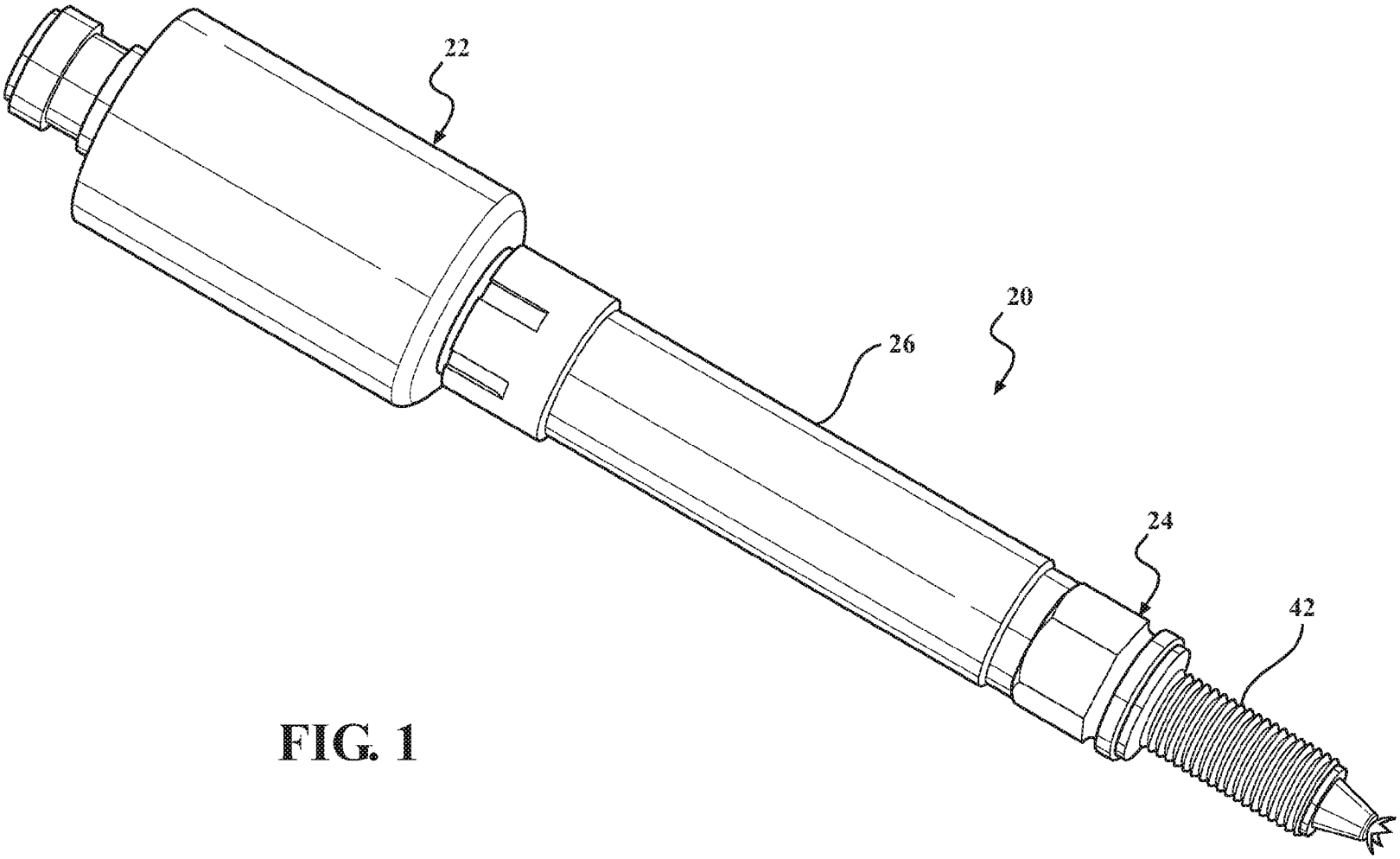
FIG. 1 is a perspective view of a corona igniter assembly comprising a high voltage insulator, a dielectric compliant insulator, a ceramic insulator, a high voltage center electrode, an ignition coil assembly, an igniter center electrode, and a semi-conductive sleeve in an assembled position according to one exemplary embodiment of the invention.

A corona igniter assembly 20 for receiving a high radio frequency voltage and distributing a radio frequency electric field in a combustion chamber containing a mixture of fuel and gas to provide a corona discharge is generally shown in FIG. 1. The corona igniter assembly 20 includes an ignition coil assembly 22, a firing end assembly 24, and a metal tube 26 surrounding and coupling the ignition coil assembly 22 to the firing end assembly 24. The corona igniter assembly 20 also includes a high voltage insulator 28 and an optional dielectric compliant insulator 30 each disposed between the ignition coil assembly 22 and a ceramic insulator 32 of the firing end assembly 24, inside of the metal tube 26. A high voltage center electrode 62 connects the ignition coil assembly 22 to the firing end assembly 24. A semi-conductive sleeve 76 extends continuously along the interfaces between the different insulators 28, 30, 32. The semi-conductive sleeve 76 dampens the peak electric field and fills air gaps located along the high voltage center electrode 62 and adjacent insulators 28, 30, 32, which in turn prevents unwanted corona discharge.

Figure 3:
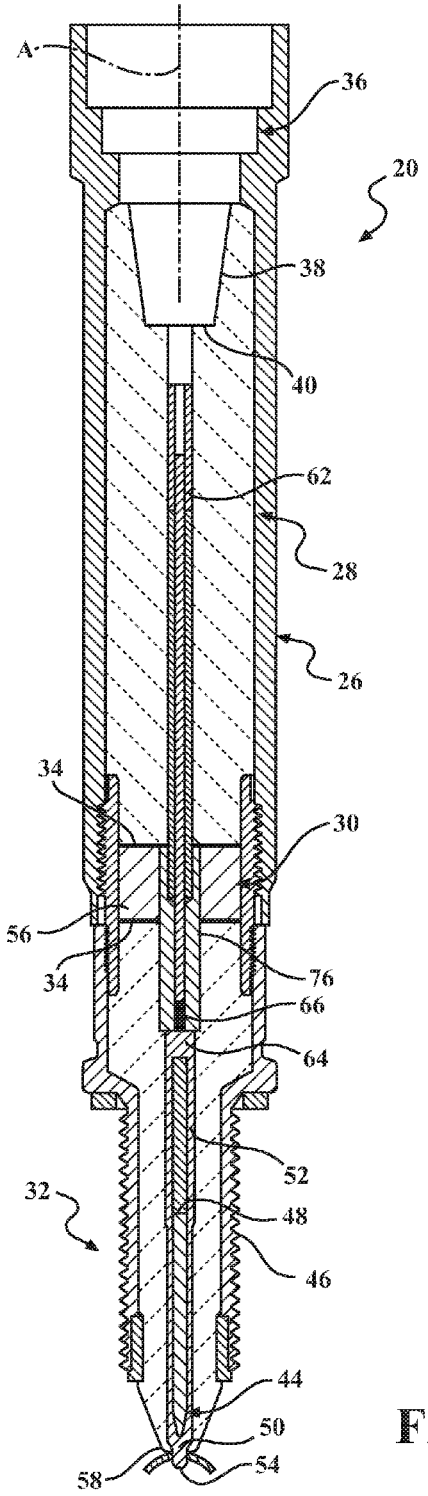
FIG. 3 is a is a cross-sectional view of the corona igniter assembly of FIG. 1 with the ignition coil assembly received by the high voltage insulator.

The ignition coil assembly 22 includes a plurality of windings (not shown) receiving energy from a power source (not shown) and generating the high radio frequency and high voltage electric field. The ignition coil assembly 22 extends along a center axis A and includes a coil output member 36 for transferring energy toward the firing end assembly 24. In the exemplary embodiment, the coil output member 36 is formed of plastic material. As shown in FIG. 3, the coil output member 36 presents an output side wall 38 which tapers toward the center axis A to an output end wall 40. The output side wall 38 has a conical shape, and the output end wall 40 extends perpendicular to the center axis A. In addition, a coil connector 86 typically extends outwardly of the coil output member 36 and abuts the high voltage center electrode 62.

Figure 2:
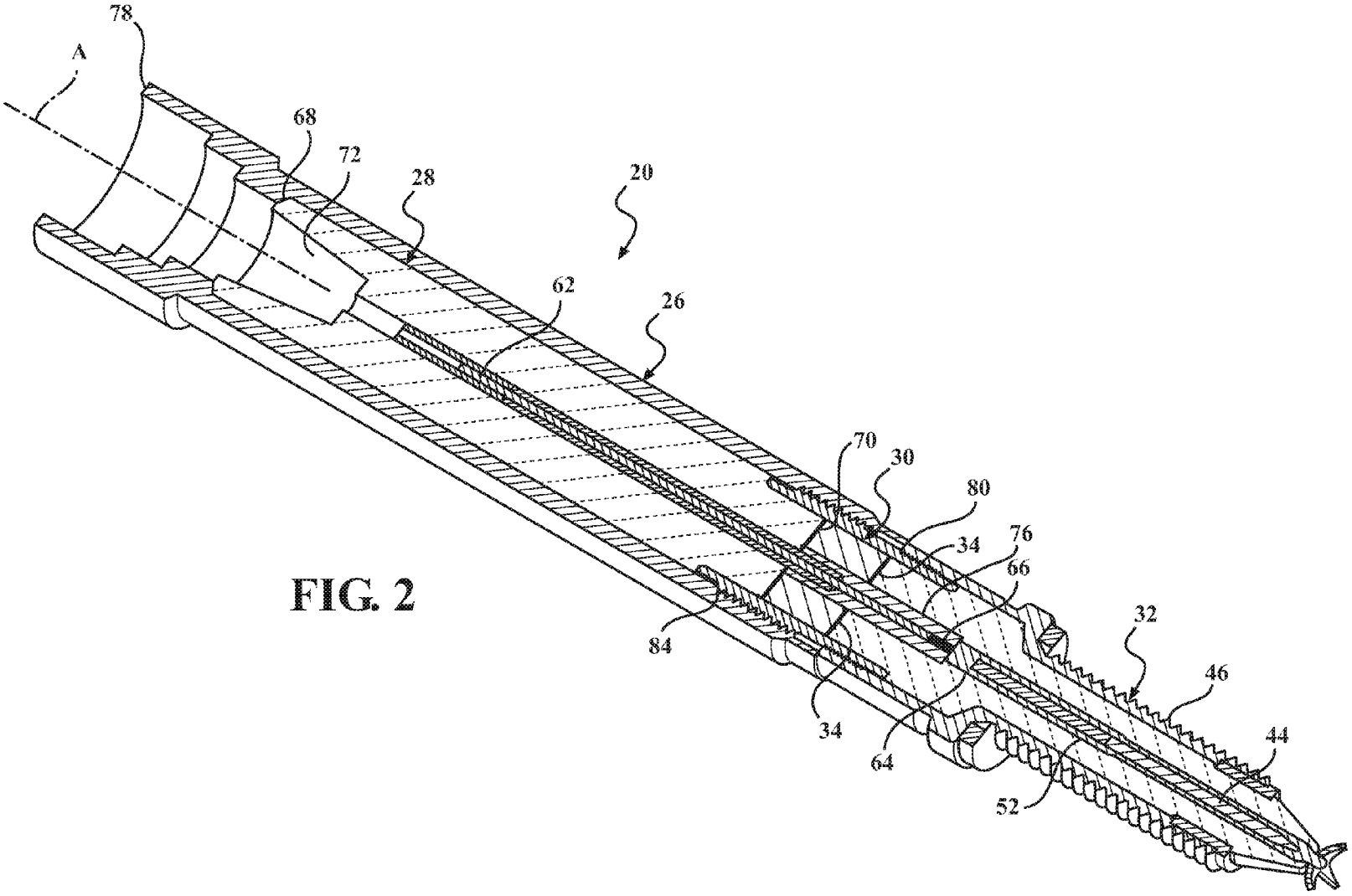
FIG. 2 is a cross-sectional view of the corona igniter assembly of FIG. 1 with the ignition coil assembly removed.

The firing end assembly 24 includes a corona igniter 42, as shown in FIGS. 1-3, for receiving the energy from the ignition coil assembly 22 and distributing the radio frequency electric field in the combustion chamber to ignite the mixture of fuel and air. The corona igniter 42 includes an igniter center electrode 44, a metal shell 46, and the ceramic insulator 32. The ceramic insulator 32 includes an insulator bore receiving the igniter center electrode 44 and spacing the igniter center electrode 44 from the metal shell 46.

The igniter center electrode 44 of the firing end assembly 24 extends longitudinally along the center axis A from a terminal end 48 to a firing end 50. In the exemplary embodiment, the igniter center electrode 44 has a thickness in the range of 0.8 mm to 3.0 mm. In the preferred embodiment, an electrical terminal 52 is disposed on the terminal end 48, and a crown 54 is disposed on the firing end 50 of the igniter center electrode 44. The crown 54 includes a plurality of branches extending radially outwardly relative to the center axis A for distributing the radio frequency electric field and forming a robust corona discharge.

Figure 4:
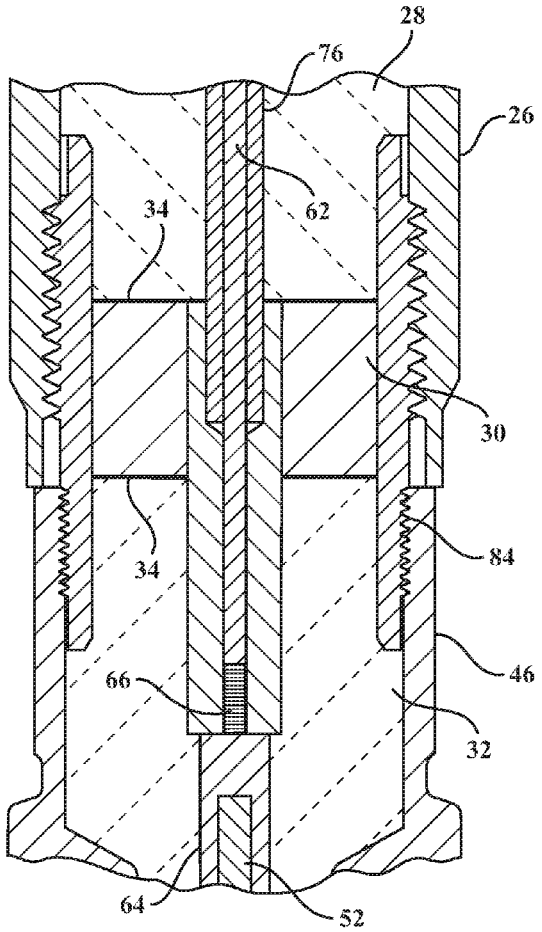
FIG. 4 is an enlarged view of a section of the corona igniter assembly of FIG. 3 showing diameters of the high voltage center electrode, dielectric compliant insulator, and semi-conductive sleeve.
Figure 5:
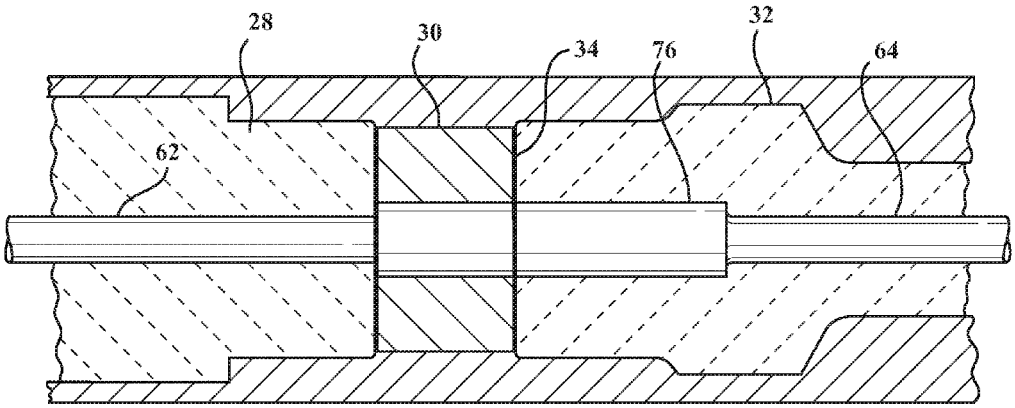
FIG. 5 is an enlarged view of the insulators of the corona igniter assembly according to the exemplary embodiment.
Figure 13:
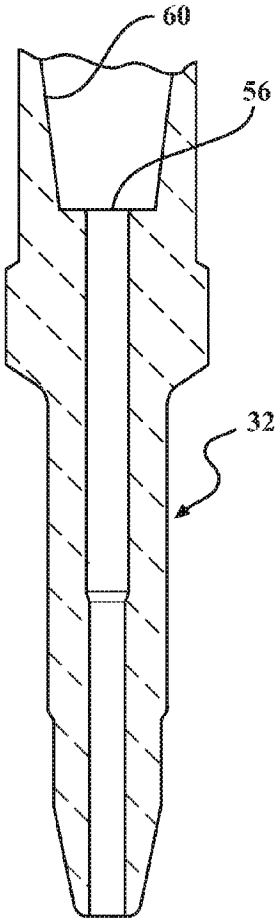
FIG. 13 is a cross-sectional view of the ceramic insulator according to yet another embodiment.
Figure 12:
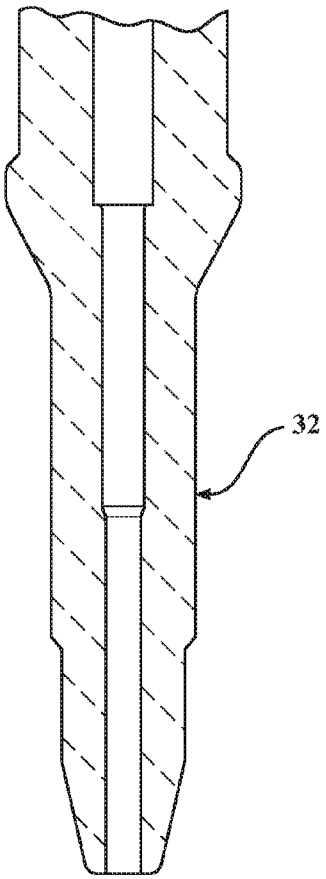
FIG. 12 is a cross-sectional view of the ceramic insulator according to another embodiment.
Figure 11:
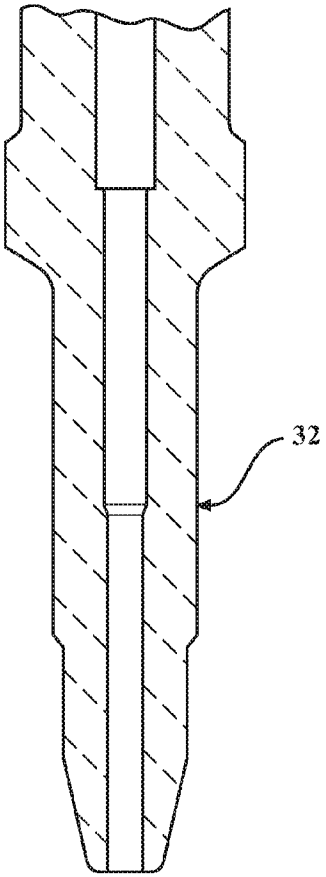
FIG. 11 is a cross-sectional view of the ceramic insulator of the exemplary embodiment of FIGS. 2-4.
Figure 14:
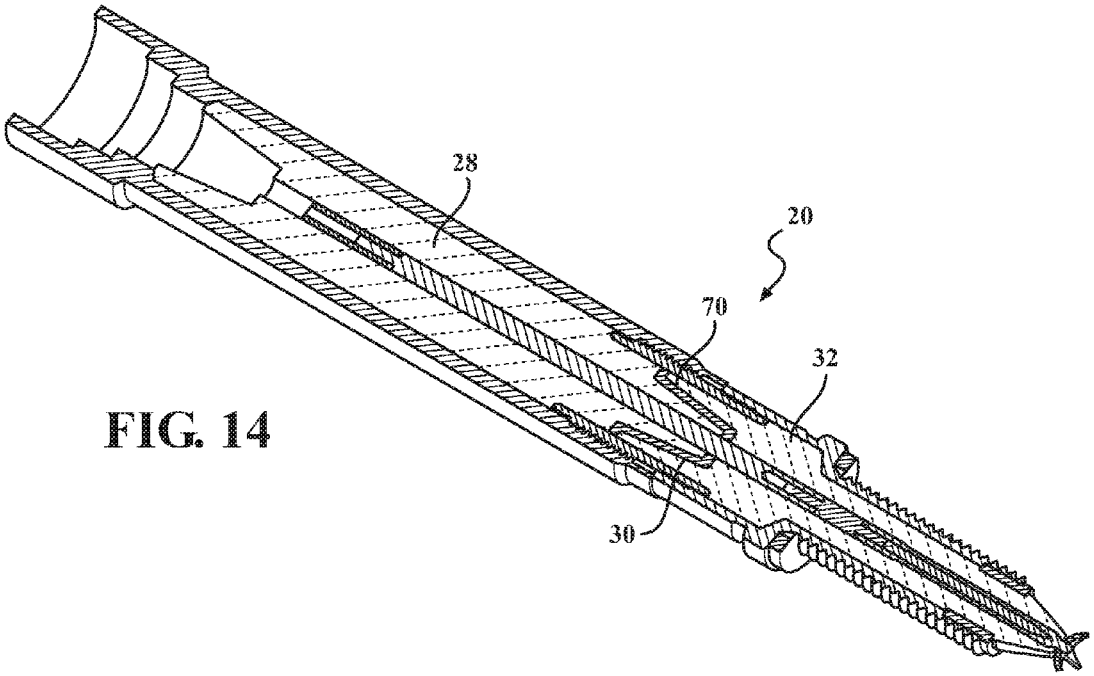
FIG. 14 is a cross-sectional view of the corona igniter assembly of according to a second exemplary with the ignition coil assembly removed.
Figure 15:
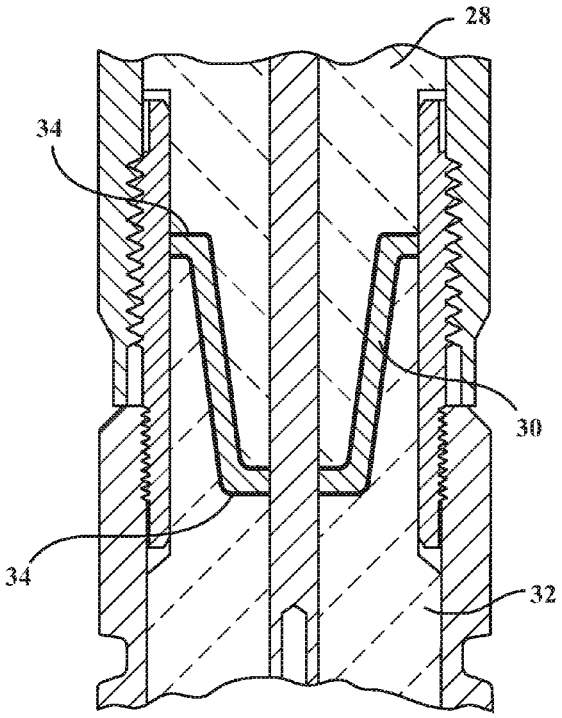
FIG. 15 is an enlarged view of a section of the corona igniter assembly of FIG. 14 showing the insulator interfaces where the glue is applied.
Figure 16:
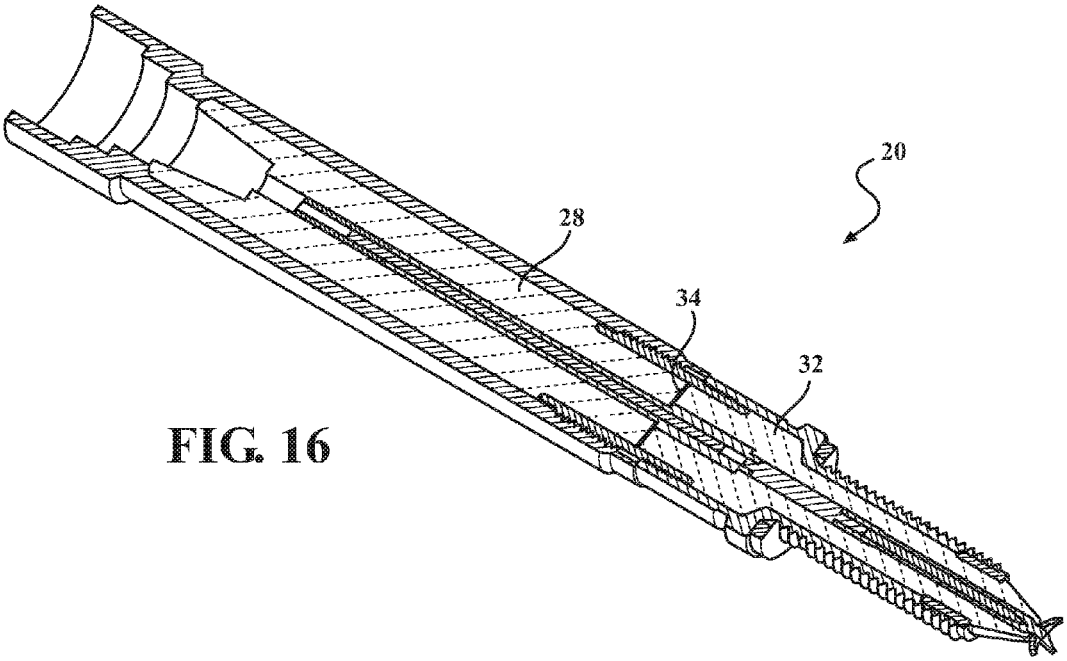
FIG. 16 is a cross-sectional view of the corona igniter assembly of according to a third exemplary which does not include the dielectric compliant insulator.
Figure 18:
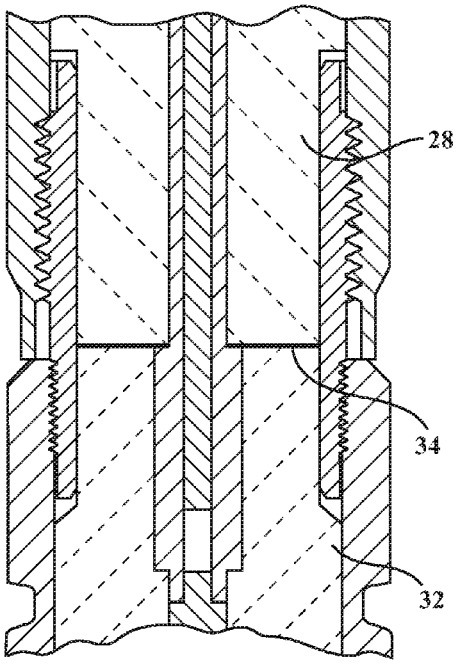
FIG. 18 is an enlarged view of a section of the corona igniter assembly of FIG. 17 showing the glue applied to interfaces between the high voltage insulator and the ceramic insulator.
Figure 19:
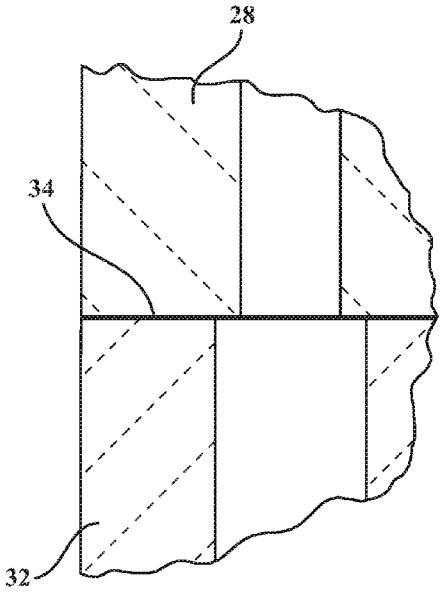
FIG. 19 is an enlarged view of the glue along the interfaces of FIG. 18.
Figure 17:
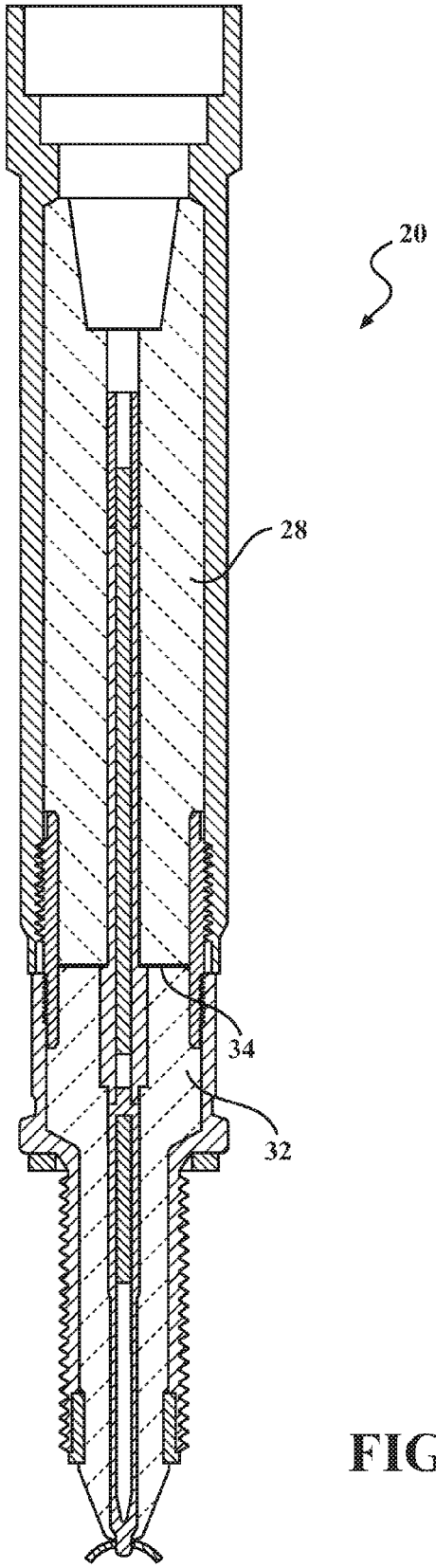
FIG. 17 is another cross-sectional view of the corona igniter assembly of FIG. 16.
Figure 20:
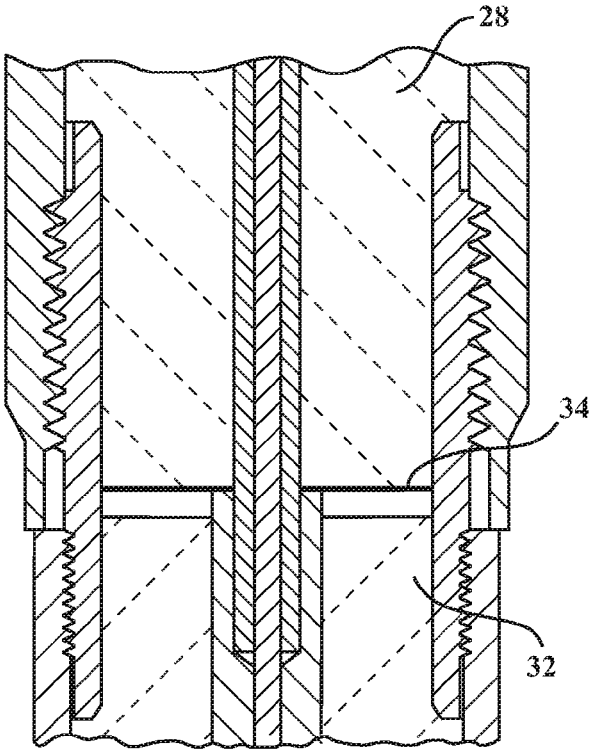
FIG. 20 shows a section of the corona igniter assembly according to a fourth exemplary embodiment which includes a thicker layer of the glue along the interface between the high voltage insulator and the ceramic insulator.

The ceramic insulator 32, also referred to as the firing end insulator 32, includes a bore receiving the igniter center electrode 44 and can be formed of various different ceramic materials which are capable of withstanding the operating conditions in the combustion chamber. In one exemplary embodiment, the ceramic insulator 32 is formed of alumina. The material used to form the ceramic insulator 32 also has a high capacitance which drives the power requirements for the corona igniter assembly 20 and therefore should be kept as small as possible. The ceramic insulator 32 extends along the center axis A from a ceramic end wall 56 to a ceramic firing end 58 adjacent the firing end 50 of the igniter center electrode 44. The ceramic end wall 56 is typically flat and extends perpendicular to the center axis A, as shown in FIGS. 2-4. In another embodiment, the ceramic insulator 32 includes a ceramic side wall 60 having a conical shape and extending to the ceramic end wall 56, as shown in FIGS. 13-15. In this embodiment, the igniter center electrode 44 is wider but is still within the range of 0.8 to 3.0 mm. The metal shell 46 surrounds the ceramic insulator 32, and the crown 54 is typically disposed outwardly of the ceramic firing end 58.

The high voltage center electrode 62 is received in the bore of the ceramic insulator 32 and extends to the coil output member 36, as shown in FIGS. 2 and 3. The high voltage center electrode 62 is formed of a conductive metal, such as brass. As shown in FIG. 4, the high voltage center electrode 62 presents an electrode outer diameter $D_1$ extending perpendicular to the center axis A, and which can be constant or vary along the center axis A. In the exemplary embodiment, the electrode outer diameter $D_1$ stays constant. Preferably, a brass pack 64 is disposed in the bore of the ceramic insulator 32 to electrically connect the high voltage center electrode 62 and the electrical terminal 52. In addition, the high voltage center electrode 62 is preferably able to float along the bore of the high voltage insulator 28. Thus, a spring 66 or another axially complaint member is disposed between the brass pack 64 and the high voltage center electrode 62. Alternatively, although not shown, the spring 66 could be located between the high voltage center electrode 62 and the coil output member 36.

In the exemplary embodiment of FIGS. 2-4, the high voltage insulator 28 extends between an HV insulator upper wall 68 coupled to the coil output member 36 and an HV insulator lower wall 70 coupled to the dielectric compliant insulator 30. The HV insulator lower wall 70 could alternatively be coupled to the ceramic insulator 32. The high voltage insulator 28 preferably fills the length and volume of the metal tube 26 located between the ceramic insulator 32 or the optional dielectric compliant insulator 30 and the ignition coil assembly 22. In the exemplary embodiment shown in FIGS. 2-4, the high voltage insulator 28 also includes an HV insulator side wall 72 adjacent the HV insulator end wall 74 which mirrors the size and shape of the coil output member 36.

In the exemplary embodiment of FIGS. 2-4, the HV insulator lower wall 70 and the ceramic end wall 56 are both flat. In the embodiments of FIGS. 14 and 15, however, the HV insulator lower wall 70 has a conical shape which mirrors the conical shape of the ceramic end wall 56. This conical connection provides a better escape for any air present between the components during the assembly process. However, the flat connection provides for a more even distribution of the forces on the dielectric compliant insulator 30 and thus provides for a better seal.

The high voltage insulator 28 is formed of an insulating material which is different from the ceramic insulator 32 of the firing end assembly 24 and different from the optional dielectric compliant insulator 30. Typically, the high voltage insulator 28 has a coefficient of thermal expansion (CLTE) which is greater than the coefficient of thermal expansion (CLTE) of the ceramic insulator 32. This insulating material has electrical properties which keeps capacitance low and provides good efficiency. Table 1 lists preferred dielectric strength, dielectric constant, and dissipation factor ranges for the high voltage insulator 28; and Table 2 lists preferred thermal conductivity and coefficient of thermal expansion (CLTE) ranges for the high voltage insulator 28. In the exemplary embodiment, the high voltage insulator 28 is formed of a fluoropolymer, such as polytetrafluoroethylene (PTFE). The outer surface of the fluoropolymer is chemically etched prior to applying the glue 34 since no material can stick to the unprocessed fluoropolymer. The high voltage insulator 28 could alternatively be formed of other materials having electrical properties within the ranges of Table 1 and thermal properties within the ranges of Table 2.

TABLE 1

| Parameter | Value | U.M. | Testing conditions |
|---|---|---|---|
| Dielectric strength | >30 | kV/mm | −40° C., +150° C. |
| Dielectric constant | ≤2.5 | | 1 MHz; −40° C., +150° C. |
| Dissipation factor | <0.001 | | 1 MHz −40° C., +150° C. |

TABLE 2

| | | | |
|---|---|---|---|
| Thermal conductivity | >0.8 | W/mK | 25° C. |
| CLTE | <35 | ppm/K | −40° C., +150° C. |

In the exemplary embodiments shown in FIGS. 2-15, the dielectric compliant insulator 30 is compressed between the high voltage insulator 28 and the ceramic insulator 32. The dielectric compliant insulator 30 provides an axial compliance which compensates for the differences in coefficients of thermal expansion between the high voltage insulator 28 and the ceramic insulator 32. Preferably, the hardness of the dielectric compliant insulator 30 ranges from 40 to 80 (shore A). The compression force applied to the dielectric compliant insulator 30 is set to be within the elastic range of the complaint material. Typically, the dielectric compliant insulator 30 is formed of rubber or a silicon compound, but could also be formed of silicon paste or injection molded silicon.

In the embodiment shown in FIGS. 2-4, when the HV insulator lower wall 70 and the ceramic end wall 56 are both flat, the surfaces of the dielectric compliant insulator 30 are also flat. In the alternate embodiment shown in FIGS. 14 and 15, the dielectric compliant insulator 30 conforms to the conical shapes of the HV insulator lower wall 70 and the ceramic end wall 56. The flat dielectric compliant insulator 30, however, is thicker and thus provides for improved axial compliance.

Figure 21:
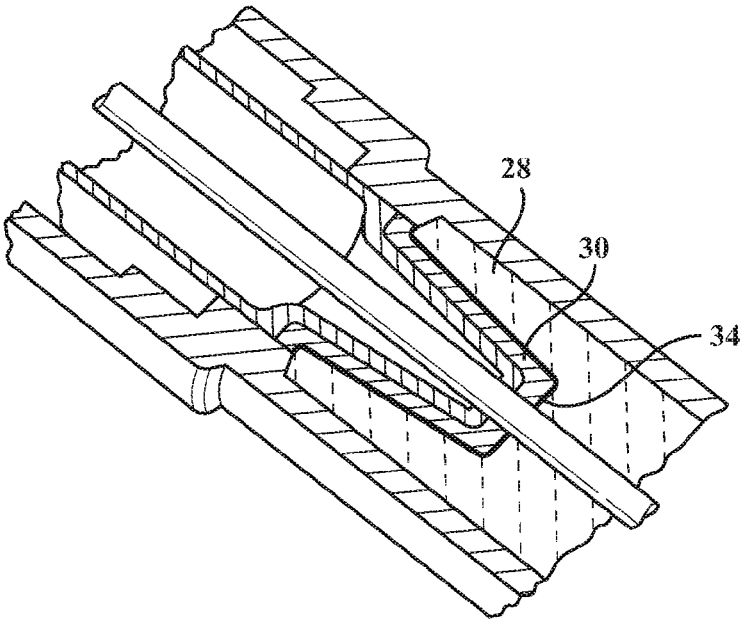
FIG. 21 is a cross-sectional view of a section of a corona igniter assembly according to a fifth another exemplary embodiment which includes the dielectric compliant insulator sandwiched between the ignition coil assembly and the high voltage insulator.
Figure 22:
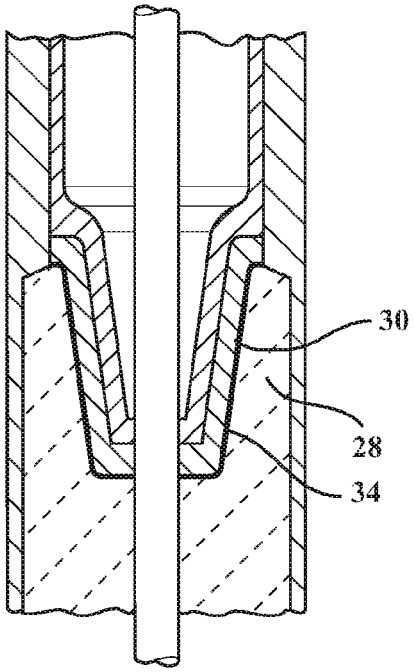
FIG. 22 is an enlarged cross-sectional view of the corona igniter assembly of FIG. 21.
Figure 23:
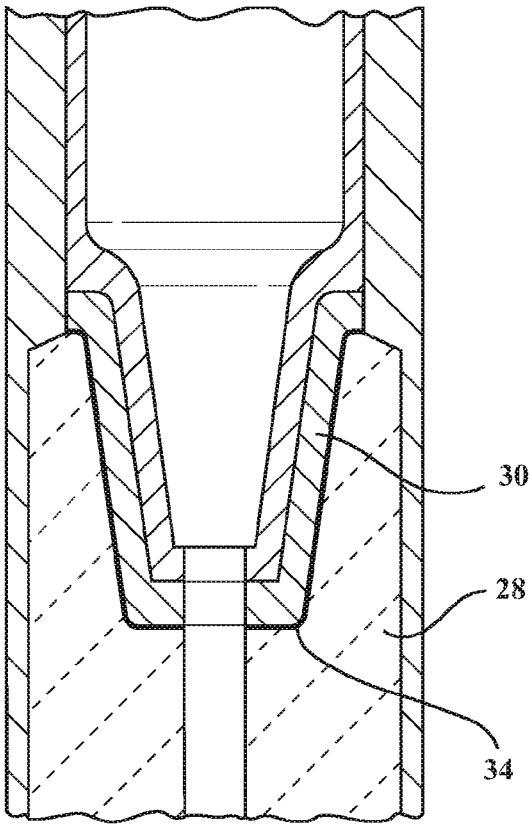
FIG. 23 is another enlarged cross-sectional view of the corona igniter assembly of FIG. 21.

In another embodiment, shown in FIGS. 16-20, the corona igniter assembly 20 is formed without the dielectric compliant insulator 30. In yet another embodiment, shown in FIGS. 21-23, the dielectric compliant insulator 30 is moved toward the ignition coil assembly 22. In this embodiment, the dielectric compliant insulator 30 is sandwiched between the coil output member 36 and the HV insulator upper wall 68, which is a cooler area of the corona igniter assembly 20. Moving the dielectric compliant insulator 30 to this cooler area of the corona igniter assembly 20 can also improve robustness. In yet another embodiment, the corona igniter assembly 20 includes the dielectric compliant insulator 30 in both locations.

The metal tube 26 of the corona igniter assembly 20 surrounds the insulators 28, 30, 32 and the high voltage center electrode 62 and couples the ignition coil assembly 22 to the firing end assembly 24. In the exemplary embodiment, the metal tube 26 extends between a coil end 78 attached to the ignition coil assembly 22 and a tube firing end 80 attached to the metal shell 46. The metal tube 26 typically surrounds and extends along the entire length of the high voltage insulator 28 and the semi-conductive sleeve 76. The metal tube 26 also surrounds at least a portion of the coil output member 36 and at least a portion of the high voltage center electrode 62. The metal tube 26 can also surround the optional dielectric compliant insulator 30 and/or a portion of the ceramic insulator 32. As best shown in FIG. 4, the metal tube presents a tube inner diameter $D_2$ extending perpendicular to the center axis A, and which can be constant or vary along the center axis A. In the exemplary embodiment, the tube inner diameter $D_2$ stays constant between the coil end 78 and the tube firing end 80.

Figure 24:
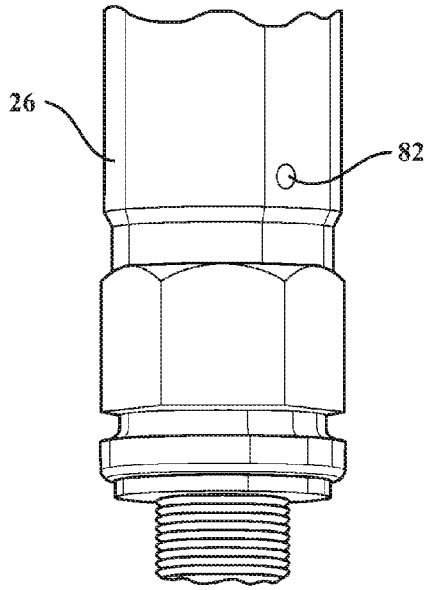
FIG. 24 is a perspective view of a section of the corona igniter assembly according to an exemplary embodiment which includes exhaust holes in the metal tube.
Figure 25:
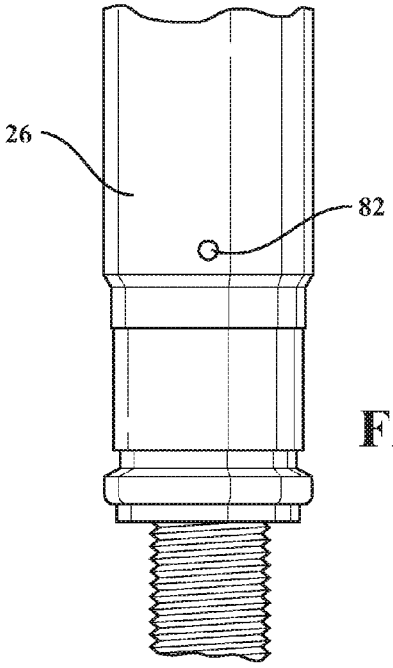
FIG. 25 is a front view of the corona igniter assembly of FIG. 24 showing one of the exhaust holes.
Figure 26:
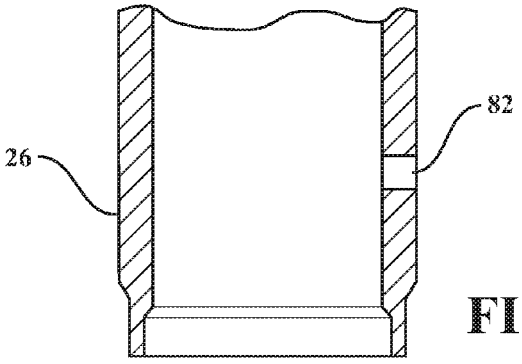
FIG. 26 is a cross-sectional view of the metal tube of FIG. 24 showing one of the exhaust holes.

The metal tube 26 is typically formed of aluminum or an aluminum alloy, but may be formed of other metal materials. The metal tube 26 can also include at least one exhaust hole 82, as shown in FIGS. 24-26, for allowing air and excess glue 34 to escape from the interior of the metal tube 26 during the manufacturing process. In addition, the coil end 78 and/or the tube firing end 80 of the metal tube 26 can be tapered.

As stated above, the electric field concentrated at the interface of the different insulators 28, 30, 32 and the high voltage center electrode 62 is high, and typically higher than the voltage required for inception of corona discharge. Thus, the corona igniter assembly 20 includes the semi-conductive sleeve 76 surrounding a portion of the high voltage center electrode 62 to dampen the peak electric field and fill air gaps along the high voltage center electrode 62 and adjacent insulators 28, 30, 32. The semi-conductive sleeve 76 preferably extends continuously, uninterrupted, along the interfaces between the different insulators 28, 30, 32. In the exemplary embodiment, the semi-conductive sleeve 76 extends continuously, uninterrupted, from adjacent the coil output member 36 to the brass pack 64.

As best shown in FIGS. 2-4, the semi-conductive sleeve 76 is disposed radially between the high voltage center electrode 62 and the insulators 28, 30, 32 and extends axially along an interface between the adjacent insulators 28, 30, 32. If the optional dielectric complaint insulator 30 is not present, then the semi-conductive sleeve 76 is only disposed along the interface between the high voltage insulator 28 and the ceramic insulator 32. As shown in FIGS. 3 and 4, the conductive sleeve 76 extends from an upper sleeve end 88 to a lower sleeve end 90. The upper sleeve end 88 is located along the high voltage insulator 28 and is typically close to the coil connector 86. The lower sleeve end 90 is located along the ceramic insulator 32 and typically rests on the brass pack 64.

The semi-conductive sleeve 76 is formed from a semi-conductive and compliant material, which is different from the other semi-conductive and complaint materials used in the corona igniter assembly 20. The complaint nature of the semi-conductive sleeve 76 allows the semi-conductive sleeve 76 to fill the air gaps along the high voltage center electrode 62 and the insulators 28, 30, 32. In the exemplary embodiment, the semi-conductive sleeve 76 is formed of a semi-conductive rubber material, for example a silicone rubber. The semi-conductive sleeve 76 includes some conductive material, for example a conductive filler, to achieve the partially conductive properties. In one embodiment, the conductive filler is graphite or a carbon-based material, but other conductive or partially conductive materials could be used. The material used to form the semi-conductive sleeve 76 can also be referred to as partially conductive, weakly-conductive, or partially resistive. The high voltage and high frequency (HV-HF) nature of the semi-conductive sleeve behaves like a conductor. The resistivity or DC conductivity of the semi-conductive sleeve 76 can vary from 0.5 Ohm/mm to 100 Ohm/mm, without sensibly changing the behavior of the corona igniter assembly 20. In the exemplary embodiment, the semi-conductive sleeve 76 has a DC conductivity of 1 Ohm/mm. The peak electrical field within the assembly 20 can be minimized by the conductive nature at high voltage and high frequency (HV-HF) of the semi-conductive sleeve 76 placed between the high voltage center electrode 62 and the insulators 28, 30, 32. The semi-conductive sleeve 76 ensures that all cavities and irregularities within the assembly 20 at the interfaces are not filled with electrical charge. The stress-relieving function of the semi-conductive sleeve 76 also prevents the joint from failing.

The semi-conductive sleeve 76 includes a sleeve outer surface 92 and a sleeve inner surface 94 each presenting a cylindrical shape. The high voltage center electrode 62 and spring 66 are received along the sleeve inner surface 94, and the sleeve outer surface 92 engages the insulators 28, 30, 32. The semi-conductive sleeve 76 can be formed of a single piece of material, or multiple pieces which can have the same or different composition. The sleeve outer surface 92 also presents a sleeve outer diameter $D_3$ extending perpendicular to the center axis A. The sleeve outer diameter $D_3$ can be constant or vary along the center axis A between the sleeve upper end 88 and the sleeve lower end 90. In the exemplary embodiment, the semi-conductive sleeve 76 is formed of two pieces of material, wherein an upper piece 96 is received in a lower piece 98, as best shown in FIG. 4. In this embodiment, the sleeve outer diameter $D_3$ is greater along the lower piece 98 than the upper piece 96. However, the sleeve inner surface 94 presents a constant inner diameter along both pieces 96, 98, which is equal to the electrode outer diameter $D_1$.

The main constraints that control the design of the corona igniter assembly 29 are the maximum voltage across the insulators 28, 30, 32 and the distance between the high voltage center electrode 62 and the external metal tube 26. These parameters are typically fixed by the overall geometry and performance requirements, and thus the ratios between the diameters of the high voltage center electrode $D_1$, the metal tube $D_2$, and the semi-conductive sleeve $D_3$, are tuned to control the distribution of the electrical field within the corona igniter assembly 20. The design goal is the keep the electric field peaks as low as possible and generally below the corona inception voltage. There is a range of diameters that allow this goal to be achieved, for example diameters that fall within the ratio limits provided below. However, new geometry constraints or other factors may force the design to adapt different ratios.

$D_1:D_2$=0.036-0.215

$D_3:D_2$=0.107-0.357

$D_1:D_3$:=0.1-2.0

In the exemplary embodiment, the following ratios were used to keep the electric field peaks as low as possible and generally below the corona inception voltage:

$D_1:D_2$=0.071

$D_3$ (upper piece):$D_2$=0.180

$D_3$ (lower piece):$D_2$=0.286

$D_1:D_3$ (upper piece):=0.400

$D_1:D_3$ (lower piece):=0.250

Table 3 provides examples of the electric field reduction and the interfaces with various different diameter ratios.

TABLE 3

| | OD brass terminal (mm) | Semicond rubber thickness (mm) | Total OD (mm) | Emax terminal (kV/mm) | Emax semicond (kV/mm) | Emin ext_OD (kV/mm) |
|---|---|---|---|---|---|---|
| 1 | 2.5 | 0 | 2.5 | 13.4 | | 2.2 |
| 2 | 4.0 | 0 | 4.0 | 11.5 | | 3.0 |
| 3 | 2.5 | 0.75 | 4.0 | 10.2 | 8.1 | 2.4 |
| 4 | 1.6 | 1.20 | 4.0 | 13.2 | 7.8 | 2.0 |
| 5 | 3.5 | 0.75 | 5.0 | 9.0 | 9.0 | 2.9 |
| 6 | 3.5 | 1.25 | 6.0 | 9.4 | 7.7 | 3.0 |
| 7 | 1.6 | 1.45 | 4.5 | 13.5 | 7.0 | 2.0 |

As discussed above, the semi-conductive sleeve 76 relieves stress and stabilizes the electrical field between the different materials disposed radially across the corona igniter assembly 20, where more air gaps or changes in geometry leading to increases in electric field typically exist. More specifically, the semi-conductive sleeve 76 minimizes the peak electric field within the corona igniter assembly 20 by contrasting the electric charge concentration in any air gaps located along the high voltage center electrode 62 or ceramic insulator 32. The voltage drop through the semi-conductive sleeve 76 is significant, and thus the voltage peak at the interface between the semi-conductive sleeve 76 and the adjacent materials is lower than the voltage peak between the high voltage center electrode 62 and the ceramic insulator 32 would be without the semi-conductive sleeve 76. The semi-conductive sleeve 76 also relieves any cavities from static electrical charge that could generate unwanted corona discharge.

Figure 27:
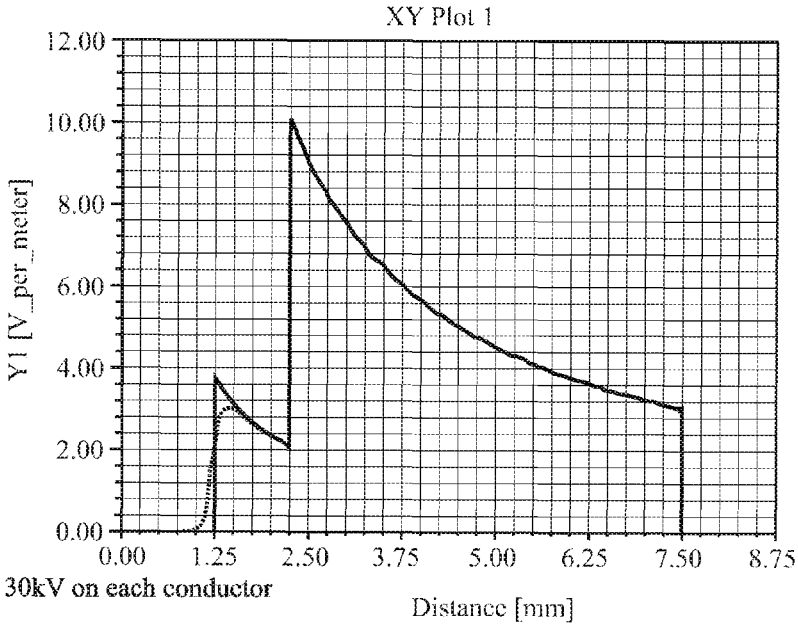
FIG. 27 is a FEA study for the electrical field distribution of the corona igniter assembly of FIG. 1 with the semi-conductive sleeve.
Figure 27:
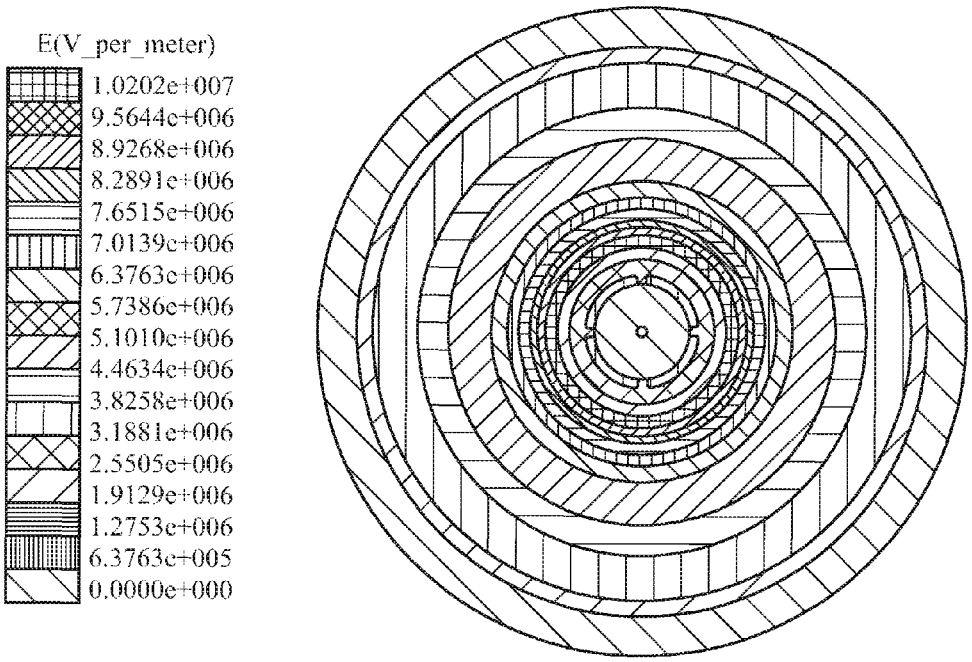
Figure 28:
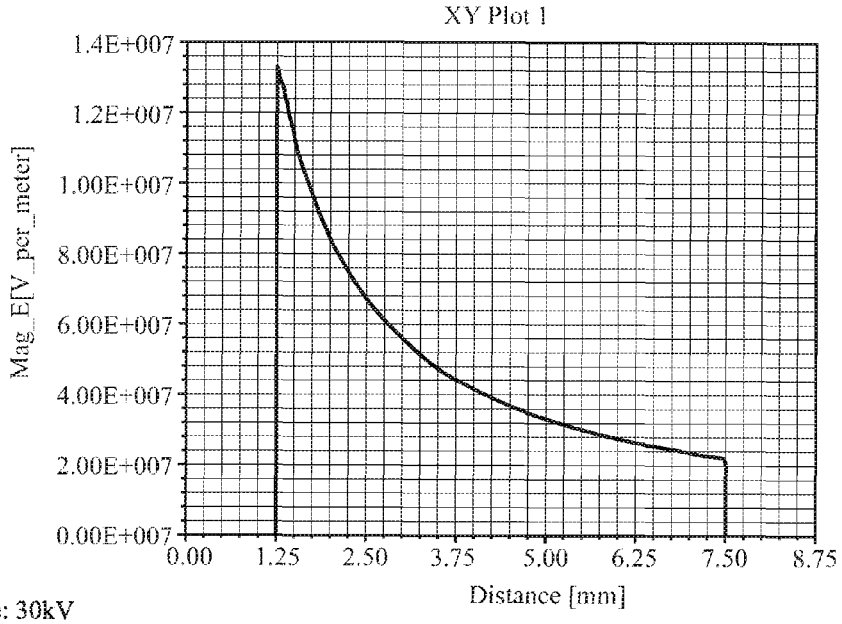
FIG. 28 is a comparative FEA study for the electrical field distribution of the assembly of FIG. 1 except without the semi-conductive sleeve.
Figure 28:
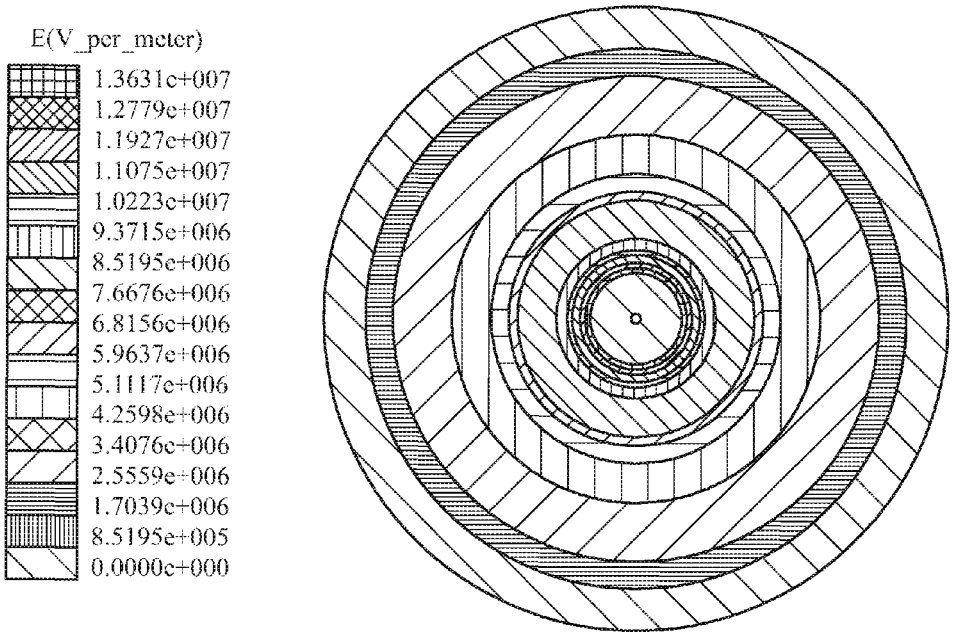
Figure 29:
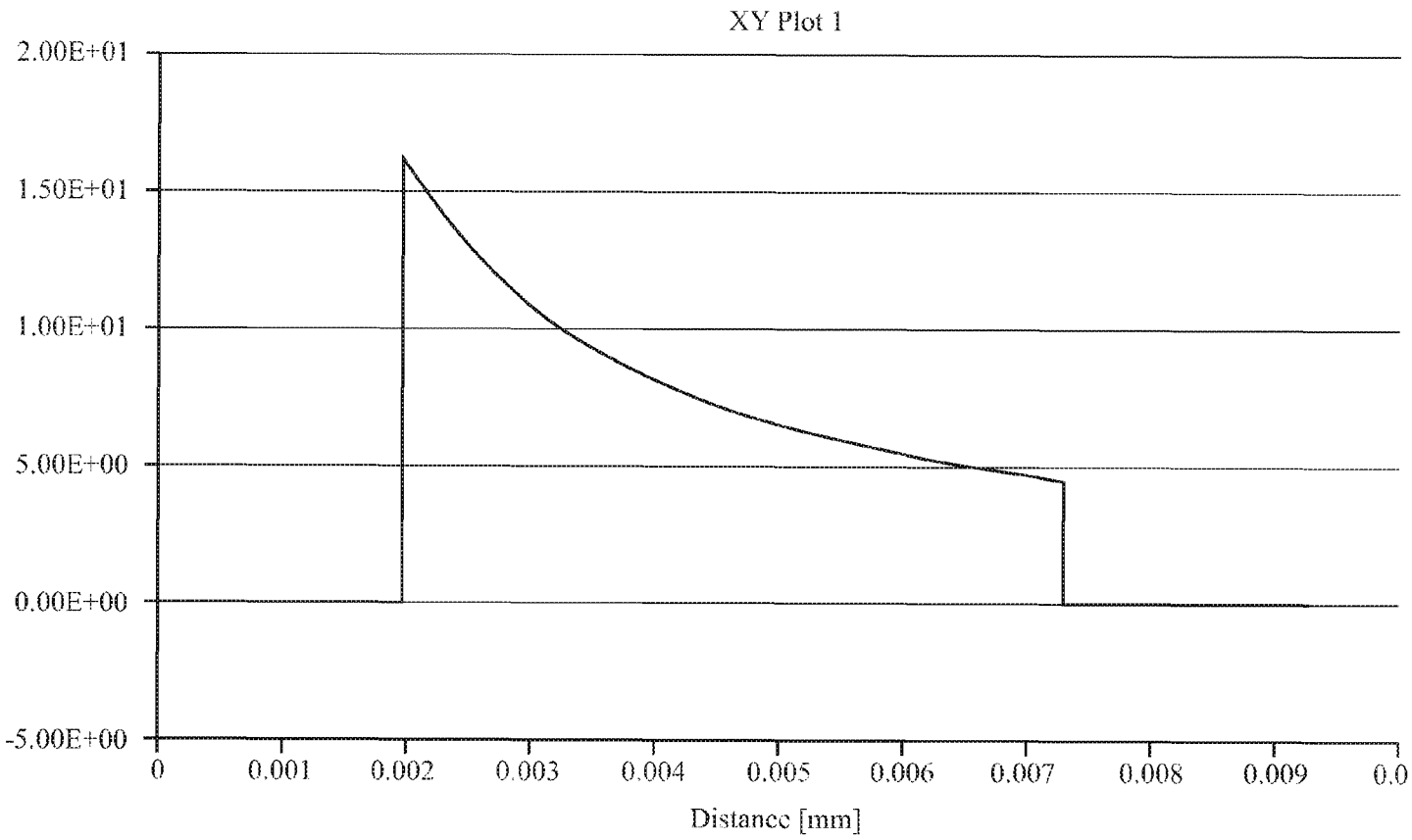
FIG. 29 is a graph illustrating results of a test conducted to compare the electrical field of the example semi-conductive sleeve to the electrical field of a conductive brass material of the same diameter.

The semi-conductive sleeve 76 is typically formed of a compliant material, and thus minimizes the amount or volume of air gaps along the interfaces between the high voltage center electrode 62 and the ceramic insulator 32. In summary, by preventing the unwanted corona discharge, the life of the materials can be extended and the energy can be directed to the corona discharge formed at the firing end 50, which in turn improves the performance of the corona igniter assembly 20. FIG. 27 includes results of a FEA study of the electrical field distribution of the corona igniter assembly 20 of FIG. 1 with the semi-conductive sleeve 76, and FIG. 28 includes results of a comparative FEA study of the electrical field distribution of the same corona igniter assembly except without the semi-conductive sleeve 76. FIG. 29 is a graph illustrating results of a test conducted to compare the electrical field of the semi-conductive sleeve 76 to the electrical field of a conductive brass material of the same diameter. The test results illustrate that the high voltage and high frequency (HV-HF) nature of the semi-conductive sleeve 76 behaves like a conductor.

In one embodiment, in addition to the semi-conductive sleeve, a glue 34 is used to further improve the high voltage seal between the high voltage center electrode 62 and adjacent insulators 28, 30, 32. The glue 34, also referred to as an adhesive sealant, is disposed along interfaces between the insulators 28, 30, 32, as shown in FIGS. 2-8. The glue 34 helps ensure that the adjacent insulators 28, 30, 32 stick together and maintain even contact. The glue 34 also eliminates air gaps or voids at the interfaces which, if left unfilled, could lead to the formation of the unwanted corona discharge.

In the exemplary embodiment, the glue 34 is applied to a plurality of interfaces between the ceramic end wall 56 of the ceramic insulator 32 and the HV insulator lower wall 70 of the high voltage insulator 28. The glue 34 functions as an overmaterial and is applied in liquid form so that it flows into all of the crevices and air gaps left between the insulators 28, 30, 32 and metal shell 46 or metal tube 26, and/or between the insulators 28, 30, 32 and high voltage center electrode 62. The glue 34 is cured during the manufacturing process and thus is solid or semi-solid (non-liquid) to provide some compliance along the interfaces in the finished corona igniter assembly 20.

The glue 34 is formed of an electrically insulating material and thus is able to withstand some corona formation. The glue 34 is also capable of surviving the ionized ambient generated by the high frequency, high voltage field during use of the corona igniter assembly 20 in an internal combustion engine. Also, when the glue 34 is applied between the ceramic insulator 32 and the high voltage insulator 28, it adheres the ceramic insulator 32 and to the high voltage insulator 28. In the exemplary embodiment, the glue 34 is formed of silicon and has the properties listed in Table 3. However, other materials having properties similar to those of Table 4 could be used to form the glue 34.

TABLE 4

| CTM* | ASTM** | Property | Unit | Result |
|---|---|---|---|---|
| | | As supplied Appearance | | Non-slump paste |
| | | Colors | | Black, white, gray |
| 0364 | D2452 | Extrusion rate[1] | g/minute | 185 |
| 0098 | | skin-over time | minutes | 15 |
| 0095 | MIL-S-8802E | Tack-free time[2] | minutes | 28 |
| Mechanical properties, cured 7 days in air at 23° C. (73° F.) and 50% relative humidity | | | | |
| 0099 | D2240 | Durometer hardness, Shore A | | 32 |
| 0137A | D412 | Tensile strength | MPa | 2.5 |
| 0137A | D412 | Elongation at break | % | 680 |
| 0137A | D412 | Tear strength - die B | kN/m | 15 |
| 0022 | D0792 | Specific gravity at 22° C. (72° F.) | | 1.4 |
| Adhesion cured 7 days at 23° C. (73° F.) and 50% relative humidity | | | | |

In the embodiments shown in FIGS. 2-9, the glue 34 is applied to the HV insulator lower wall 70 of the high voltage insulator 28, the ceramic end wall 56 of the ceramic insulator 32, and all of the surfaces of the dielectric compliant insulator 30. Bonding of the HV insulator lower wall 70 and the ceramic end wall 56 to the dielectric compliant insulator 30 is especially important. The glue 34 could also be applied along other surfaces of the high voltage insulator 28 and/or other surfaces of the ceramic insulator 32. The glue 34 could further be applied to surfaces of the high voltage center electrode 62 and/or surfaces of the semi-conductive sleeve 76. In this embodiment, the glue 34 is preferably applied to a thickness in the range of 0.05 millimeters to 4 millimeters.

Alternate embodiments of the corona igniter assembly 20 are shown in FIGS. 16-23, wherein the corona igniter assembly 20 does not include the dielectric compliant insulator 30; the dielectric compliant insulator 30 is disposed adjacent the ignition coil assembly 22; and/or the glue 34 is applied as a layer sandwiched between the HV insulator lower wall 70 and the ceramic end wall 56. When the glue 34 is applied between the HV insulator lower wall 70 and the ceramic end wall 56, the glue 34 is preferably applied to a greater thickness. For example, the glue 34 could have a thickness of 1 millimeter to 6 millimeters, or greater.

Another aspect of the invention provides a method of manufacturing the corona igniter assembly 20 including the ignition coil assembly 22, the firing end assembly 24, the metal tube 26, the insulators 28, 30, 32, the high voltage center electrode 62, and the semi-conductive sleeve 76. The method first includes preparing the components of the corona igniter assembly 20.

When the glue 34 is used in the corona igniter assembly 20, the preparation step includes preparing the surfaces of the insulators 28, 30, 32 for application of the glue 34. In the exemplary embodiment, each of the insulators 28, 30, 32 is prepared by degreasing the surfaces with acetone or alcohol and then drying for approximately 2 hours at 100° C. When the high voltage insulator 28 is formed of the fluoropolymer, the method can include etching the surfaces of the fluoropolymer so that the glue 34 will stick. The high voltage insulator 28 is first machined to its final dimension and then immersed in solution. Once the surface is clean, the surfaces to which the glue 34 will be applied are etched or hatched for about 1 to 5 minutes, typically 2 minutes. The etched high voltage insulator 28 is then washed with filtered water and is ready for application of the glue 34. Cleanliness and monitoring of the chemical processes is recommended to ensure proper bonding of the surfaces.

When the glue 34 is used, the method next includes applying the glue 34 to the surfaces of the ceramic insulator 32, the high voltage insulator 28, and the semi-conductive sleeve 76 to be joined. The method can also include applying the glue 34 to the optional dielectric compliant insulator 30. Once the glue 34 is applied, these components are joined together as shown in the Figures. In the exemplary embodiment shown in FIGS. 2-4, the glue 34 is applied to the ceramic end wall 56, the HV insulator lower wall 70, and all of the surfaces of the dielectric compliant insulator 30. In another embodiment, the glue 34 is also applied to the inner surface of the metal tube 26, and/or the inner surface of the metal shell 46.

Figure 6:
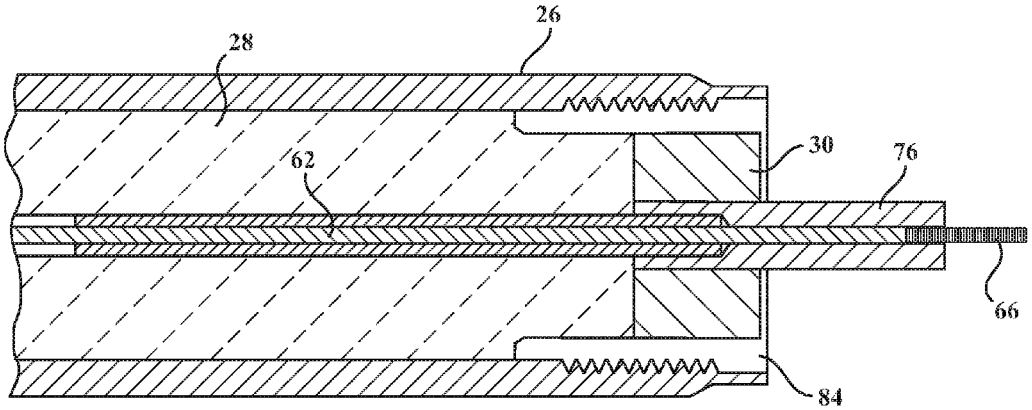
FIG. 6 shows a metal tube surrounding the high voltage insulator and the dielectric compliant insulator before the dielectric compliant insulator and semi-conductive sleeve is attached to the ceramic insulator.
Figure 7:
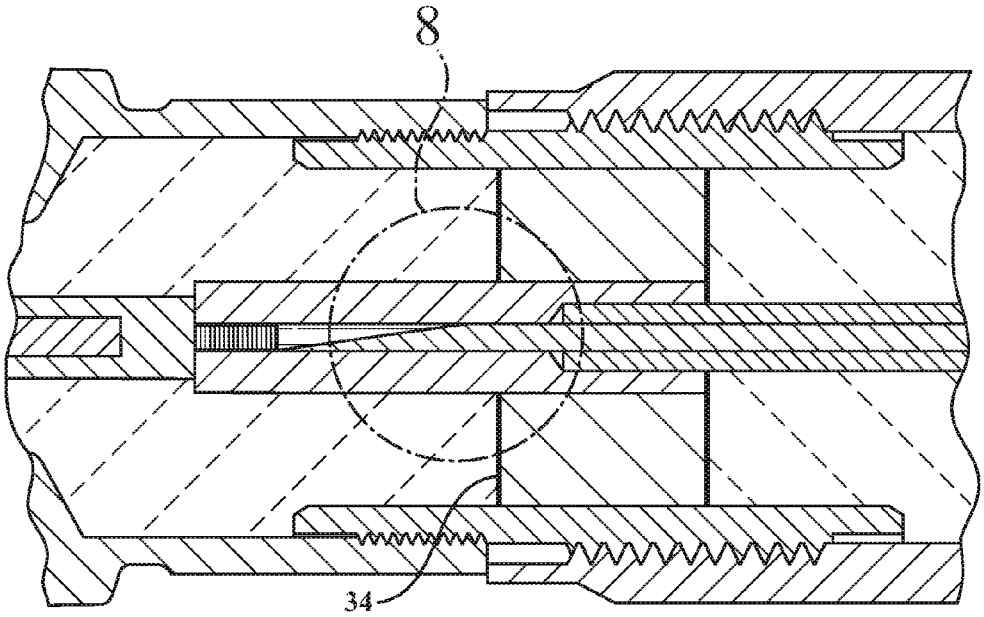
FIG. 7 is a photograph of a section of the corona igniter assembly showing the semi-conductive sleeve and a layer of glue (black) disposed along the semi-conductive sleeve and the interfaces of the insulators.
Figure 8:
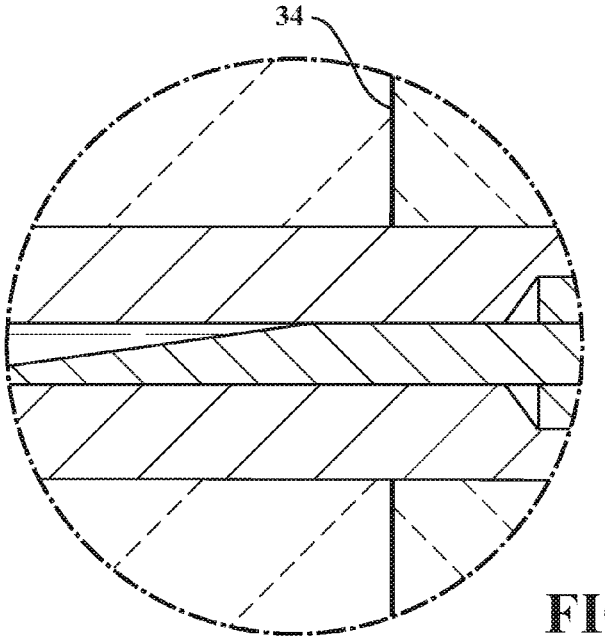
FIG. 8 is an enlarged view of section A of FIG. 7 showing the semi-conductive sleeve and the glue filling crevices along the interfaces of the insulators.
Figure 9:
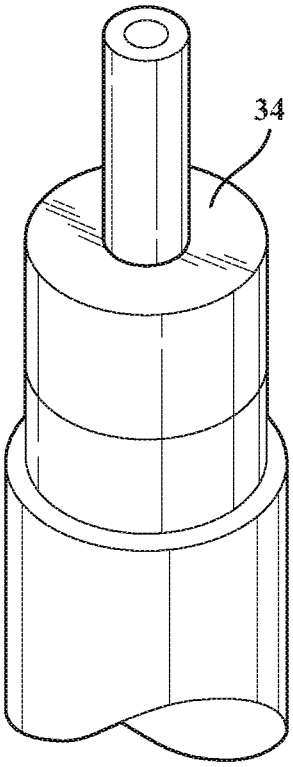
FIG. 9 is a perspective view of the semi-conductive sleeve, the high voltage insulator, and the dielectric complaint insulator before attachment to the ceramic insulator.
Figure 10:
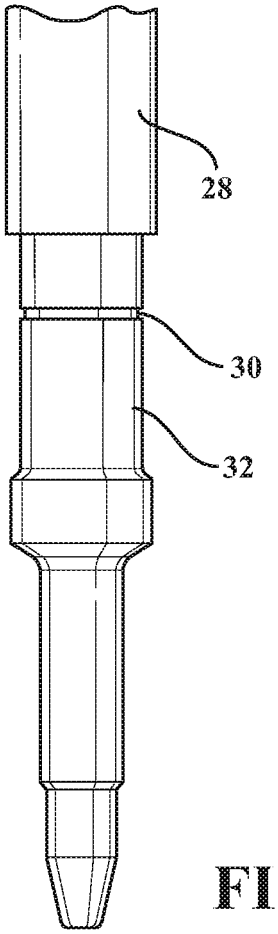
FIG. 10 is a front view of the insulator shown in FIGS. 2-4.

The high voltage insulator 28, dielectric compliant insulator 30, semi-conductive sleeve 76, and high voltage center electrode 62 are typically disposed in the metal tube 26, as shown in FIG. 6, before being coupled to the firing end assembly 24. The dielectric compliant insulator 30 is then coupled to the ceramic insulator 32 of the firing end assembly 24 via the glue 34; and the metal tube 26 is coupled to the metal shell 46 of the firing end assembly 24 via the threaded fastener 84. Once assembled, the dielectric compliant insulator 30 is sandwiched between the ceramic end wall 56 and the HV insulator lower wall 70 with the glue 34 optionally disposed along the interfaces. Preferably, any excess glue 34 is able to escape through the exhaust holes 82 in the metal tube 26. The semi-conductive sleeve 76 is also pressed between the corona igniter assembly 20 and the ignition coil assembly 22 to fill any air gaps along the insulators 28, 30, 32.

In the embodiments that employ the glue 34, the method also includes curing the joined components to increase the bond strength of the glue 34. This curing step includes heating the components in a climatic chamber at a temperature of approximately 30° C. and 75% relative humidity for 50 hours. The curing step also includes applying a pressure of 0.01 to 5 N/mm$^2$ to the joined components while heating the components in the climatic chamber.

A variety of different techniques can be used to attach the metal tube 26 to the ignition coil assembly 22 and the firing end assembly 24. In the exemplary embodiment, a separate threaded fastener 84 attaches the tube firing end 80 to the metal shell 46. The inner surface of the metal tube 26 presents a tube volume between the coil end 78 and the tube firing end 80 which could contain air gaps. However, the semi-conductive sleeve 76 and glue 34 can fill those air gaps, especially the air gaps along the interfaces of the insulators 28, 30, 32 contained within the tube volume, and thus prevents unwanted corona discharge which could otherwise form in those air gaps during use of the corona igniter assembly 20.

Obviously, many modifications and variations of the present invention are possible in light of the above teachings and may be practiced otherwise than as specifically described while within the scope of the following claims.

The invention claimed is:

1. A corona ignition assembly comprising:

an igniter central electrode surrounded by a firing end insulator, said firing end insulator being formed of a ceramic material;

a high voltage center electrode coupled to said igniter central electrode;

a high voltage insulator surrounding said high voltage center electrode, said high voltage insulator being formed of an insulating material different from said ceramic material of said firing end insulator;

a sleeve disposed radially between said high voltage center electrode and said firing end insulator and radially between said high voltage center electrode and said high voltage insulator, and said sleeve being formed of a semi-conductive material.

2. The corona ignition assembly of claim 1, wherein said semi-conductive material of said sleeve is a compliant material.

3. The corona ignition assembly of claim 2, wherein said compliant material of said sleeve is silicone rubber.

4. The corona ignition assembly of claim 2, wherein said semi-conductive material of said sleeve includes a conductive filler.

5. The corona ignition assembly of claim 4, wherein said conductive filler is a carbon-based material.

6. The corona ignition assembly of claim 1, wherein said sleeve has a resistivity of 0.5 Ohm/mm to 100 Ohm/mm.

7. The corona ignition assembly of claim 1, wherein said sleeve extends longitudinally from a sleeve upper end to a sleeve lower end, and said sleeve fills any air gaps located radially between said electrodes and said insulators in a region extending from said sleeve upper end to said sleeve lower end.

8. The corona ignition assembly of claim 1, wherein said sleeve is formed of an upper piece and a lower piece each presenting a sleeve outer diameter and a sleeve inner diameter, said sleeve outer diameter is greater along said lower piece, and said sleeve inner diameter is constant along said sleeve lower piece and said sleeve upper piece.

9. The corona ignition assembly of claim 1, wherein said high voltage insulator has a coefficient of thermal expansion (CLTE) which is greater than a coefficient of thermal expansion (CLTE) of said firing end insulator.

10. The corona ignition assembly of claim 1 including a dielectric compliant insulator extending longitudinally from a lower wall of said high voltage insulator to an end wall of said firing end insulator, said sleeve extends longitudinally through an interface between said high voltage insulator and said dielectric compliant insulator, and said sleeve extends longitudinally through an interface between said dielectric compliant insulator and said firing end insulator.

11. The corona ignition assembly of claim 10, wherein said dielectric compliant insulator has a hardness (shore A) ranging from 40 to 80.

12. The corona ignition assembly of claim 1 including a dielectric compliant insulator disposed between an upper wall of said high voltage insulator and an ignition coil assembly.

13. The corona ignition assembly of claim 1, wherein a lower wall of said high voltage insulator is joined to an end wall of said firing end insulator by an adhesive sealant, and said sleeve extends longitudinally through said adhesive sealant between said high voltage insulator and said firing end insulator.

14. The corona ignition assembly of claim 1 including a tube formed of a metal material extending longitudinally along and surrounding said insulators and said sleeve.

15. The corona ignition assembly of claim 1, wherein said high voltage center electrode is coupled to an ignition coil assembly;

said ignition coil assembly includes a coil output member for transferring energy to said high voltage center electrode, and said coil output member is formed of a plastic material;

a metal shell surrounds said firing end insulator;

said firing end insulator spaces said igniter central electrode from said metal shell;

said igniter central electrode extends longitudinally along said center axis from a terminal end to a firing end;

an electrical terminal is disposed on said terminal end of said igniter central electrode and a crown is disposed on said firing end of said igniter central electrode;

said crown includes a plurality of branches extending radially outwardly relative to said center axis for distributing a radio frequency electric field;

said firing end insulator is formed of alumina and presents a bore for receiving said igniter central electrode;

a lower portion of said high voltage center electrode is received in said bore of said firing end insulator and a second portion of said high voltage center electrode extends to said coil output member;

said high voltage center electrode is formed of a conductive metal;

a brass pack is disposed in said bore of said firing end insulator to electrically connect said high voltage center electrode and said electrical terminal;

a spring is disposed between said brass pack and said high voltage center electrode;

said high voltage insulator extends from a high voltage insulator upper wall coupled to said coil output member to a high voltage insulator lower wall;

said high voltage insulator is formed of a fluoropolymer which is different from said ceramic material of said firing end insulator;

said high voltage insulator has a coefficient of thermal expansion (CLTE) which is greater than a coefficient of thermal expansion (CLTE) of said ceramic material;

a dielectric compliant insulator is compressed between said high voltage insulator and said firing end insulator;

said dielectric compliant insulator is formed of at least one of rubber and silicon and has a hardness (shore A) ranging range from 40 to 80;

said dielectric complaint member engages and conforms to a shape of said high voltage insulator lower wall and a shape of said end wall of said firing end insulator;

said sleeve extends longitudinally through an interface between said high voltage insulator and said dielectric compliant insulator;

said sleeve extends longitudinally through an interface between said dielectric compliant insulator and said firing end insulator;

said sleeve extends from an upper sleeve end disposed in a bore of said high voltage insulator to a lower sleeve end disposed in said bore of said firing end insulator;

said lower sleeve end rests on said brass back;

said sleeve extends radially from said high voltage center electrode to said dielectric compliant insulator;

a metal tube surrounds said insulators and couples said ignition coil assembly to said metal shell;

said metal tube is formed of aluminum or an aluminum alloy;

said semi-conductive sleeve is formed of silicone rubber and includes a conductive filler, said conductive filler is a carbon-based material;

said semi-conductive sleeve has a resistivity of 0.5 Ohm/mm to 100 Ohm/mm;

a glue is disposed along an interface between said high voltage insulator and said dielectric compliant insulator and/or along an interface between said dielectric compliant insulator and said firing end insulator to fill any air gaps along said interface; and said glue is formed of an insulating material.

16. A method of manufacturing a corona ignition assembly comprising the steps of:

coupling a high voltage center electrode to an igniter central electrode;

disposing a sleeve formed of a semi-conductive material around the high voltage center electrode;

disposing a firing end insulator around the igniter central electrode and a lower sleeve end of the sleeve, the firing end insulator being formed of a ceramic material;

disposing a high voltage insulator around the high voltage center electrode and an upper sleeve end of the sleeve, wherein the high voltage insulator is formed of an insulating material different from the ceramic material of the firing end insulator.

17. The method of claim 16, wherein the semi-conductive material of the sleeve is compliant.

18. The method of claim 17, wherein the semi-conductive sleeve includes silicone rubber and a conductive filler formed of a carbon-based material, the high voltage insulator is formed of a fluoropolymer, and the firing end insulator is formed of alumina.

19. The method of claim 16 including the steps of disposing a dielectric compliant insulator around the high voltage center electrode; and compressing the dielectric complaint insulator longitudinally between the high voltage insulator and the firing end insulator.

20. The method of claim 16 including the step of disposing a metal tube around the insulators and the sleeve.

* * * * *